US006774850B2

(12) United States Patent
Chen

(10) Patent No.: US 6,774,850 B2
(45) Date of Patent: Aug. 10, 2004

(54) BROADBAND COUPLE-FED PLANAR ANTENNAS WITH COUPLED METAL STRIPS ON THE GROUND PLANE

(75) Inventor: Kuo-Cheng Chen, Taoyuan (TW)

(73) Assignee: High Tech Computer, Corp., Taoyuan (TW)

( * ) Notice: Subject to any disclaimer, the term of this patent is extended or adjusted under 35 U.S.C. 154(b) by 1 day.

(21) Appl. No.: 10/245,335

(22) Filed: Sep. 18, 2002

(65) Prior Publication Data

US 2004/0051665 A1 Mar. 18, 2004

(51) Int. Cl.[7] ..... H01Q 1/38

(52) U.S. Cl. ..... 343/700 MS; 343/702; 343/846; 343/847

(58) Field of Search ..... 343/700 MS, 702, 343/829, 846, 847, 848, 849

(56) References Cited

U.S. PATENT DOCUMENTS 4,494,120 A * 1/1985 Garay ..... 343/702
4,516,127 A * 5/1985 Siwiak ..... 343/702
4,591,863 A * 5/1986 Patsiokas ..... 343/702
4,628,322 A * 12/1986 Marko et al. ..... 343/702
4,641,366 A * 2/1987 Yokoyama et al. ..... 455/73
4,876,552 A * 10/1989 Zakman ..... 343/702

OTHER PUBLICATIONS

"Behavior of Hand–held Transceivers in the Presence of Human Body" Bachelor of Engineering Honours Thesis by Sze Yong Lee, University of Queensland, Australia, Oct. 2000.

* cited by examiner

*Primary Examiner*—Tho Phan
(74) *Attorney, Agent, or Firm*—Rabin & Berdo, P.C.

(57) ABSTRACT

A broadband couple-fed planar antenna including radiating strips on the ground plane. Plural radiating strips are electrically connected to a ground plane and are formed on the same plane of the ground plane. The radiating strip has a first segment extended from an edge of the ground and a second segment bend at an angle connected to the first segment. The couple-fed planar antenna has a feeding line coupling signals to the radiating strips. The number of the radiating strips is flexible for the required bandwidth of the couple-fed plannar antenna.

20 Claims, 10 Drawing Sheets

START 2 CHz STOP 3 CHz

START 2 CHz STOP 3 CHz

BROADBAND COUPLE-FED PLANAR ANTENNAS WITH COUPLED METAL STRIPS ON THE GROUND PLANE

BACKGROUND OF THE INVENTION

1. Field of the Invention

The present invention relates to an antenna, and particularly to a broadband couple-fed planar antenna with coupled radiating strips electrically connected to a ground plane.

2. Description of the Related Art

In the field of wireless communication systems, it is very important to develop small and low profile antennas for the miniaturization of communication equipment. Various types of the inverted-F antennas have been proposed for this application, because they are compact in their dimensions, easy to manufacture, and exhibit good electrical performance. The inverted F antenna allows a simple impedance match in a low-profile.

FIG. 1 (PRIOR ART) is the exploded view of a conventional aperture coupled microstrip antenna. As shown in FIG. 1, the aperture coupled microstrip antenna 100 includes a ground plane 110 with a aperture 111, a feeding microstrip 101 placed at one side of the ground plane 110, and a patch 120 placed at the opposite side of the ground plane 110. This antenna demonstrates a stacked configuration, exhibiting a relatively complicated structure. The dimensions of the feeding microstrip 101 and the aperture 111 should be properly designed. The dimensions of the patch 120, the radiator, are determined by the half-wavelength resonance. Therefore, for the application of bluetooth and wireless local area network (WLAN), the dimensions of the aperture coupled microstrip antenna are relatively large and thus take up space.

FIG. 2 (PRIOR ART) shows a planar inverted-F antenna with a length of approximate quarter wavelength. The planar inverted-F antenna 200 includes a patch 220, a ground plane 210, a short strip 230, and a feeding line 201. The disadvantage of the planar inverted-F antenna 200 is that it requires a short strip or short pin.

FIG. 3 (PRIOR ART) shows another planar inverted-F antenna with a direct feeding microstrip. The inverted-F antenna 300 includes a inverted-F strip 301, a ground plane 310, a metal plane 340, and via holes 330. The disadvantage of the inverted-F antenna 300 is that it requires via holes. The via holes 330 are employed in the structure to connect electrically the ground plane 310 and the metal plane 340.

A significant problem with the inverted-F antennas mentioned above is that extra fabrication processes are required.

Usually, the conventional inverted-F antenna has relatively narrow bandwidth. It is not flexible to broaden the conventional inverted-F antenna bandwidth.

A compact antenna which is broadband and compatible with PCB structure is needed.

SUMMARY OF THE INVENTION

Therefore, an object of the present invention is to provide a broadband couple-fed planar antenna, which has an flexible design in operating bandwidth and a high compatibility with PCB structure.

The present invention achieves the above-indicated objects by providing a first type of the broadband couple-fed planar antenna. It comprises one grounded radiators, electrically connected to a ground plane, having a first segment extended from an edge of the ground plane and a second segment bending at an angle, and a feeding line disposed above the ground plane and extended from the edge the ground plane and parallel to the first segment of the grounded radiator.

The present invention achieves the above-indicated objects by providing a second type of the broadband couple-fed planar antenna. It comprises two grounded radiators, electrically connected to a ground plane, having a first segment extended from an edge of the ground plane and a second segment bending at an angle, and a feeding line disposed above the ground plane and extended from the edge the ground plane and parallel to the first segment of the grounded radiators.

These two grounded radiators broaden the bandwidth of the antenna.

The present invention also discloses a third type of broadband couple-fed antenna. It comprises three grounded radiators, electrically connected to a ground plane, having a first segment extended from an edge of the ground plane and a second segment bending at an angle, and a feeding microstrip line disposed above the ground plane and extended from the edge of the ground plane and parallel to the first segment of the grounded radiators.

These three grounded radiators achieve an even broad bandwidth.

BRIEF DESCRIPTION OF THE DRAWINGS

The aforementioned objects, features and advantages of this invention will become apparent by referring to the following detailed description of the preferred embodiment with reference to the accompanying drawings, wherein.

DETAILED DESCRIPTION OF THE PREFERRED EMBODIMENT

Figure 1:
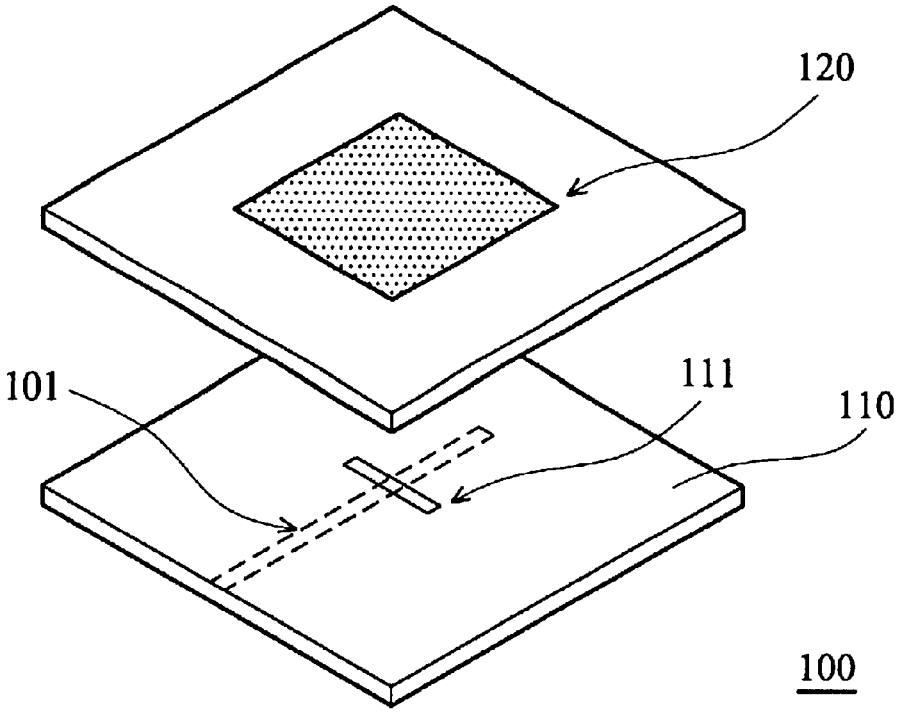
FIG. 1 ( PRIOR ART )
FIG. 1 (PRIOR ART) is the exploded view of a conventional aperture coupled microstrip antenna.
Figure 2:
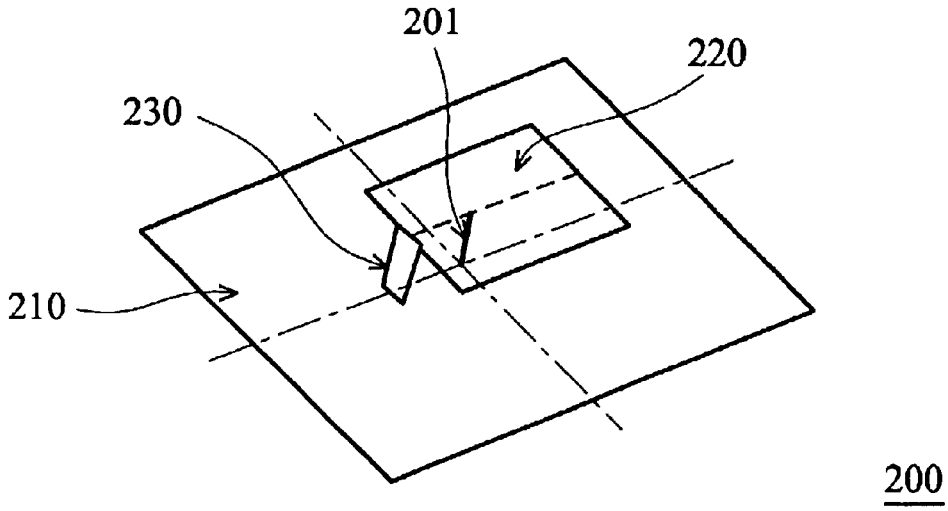
FIG. 2 ( PRIOR ART )
FIG. 2 (PRIOR ART) shows a planar inverted-F antenna with a length of approximate quarter wavelength.
Figure 3:
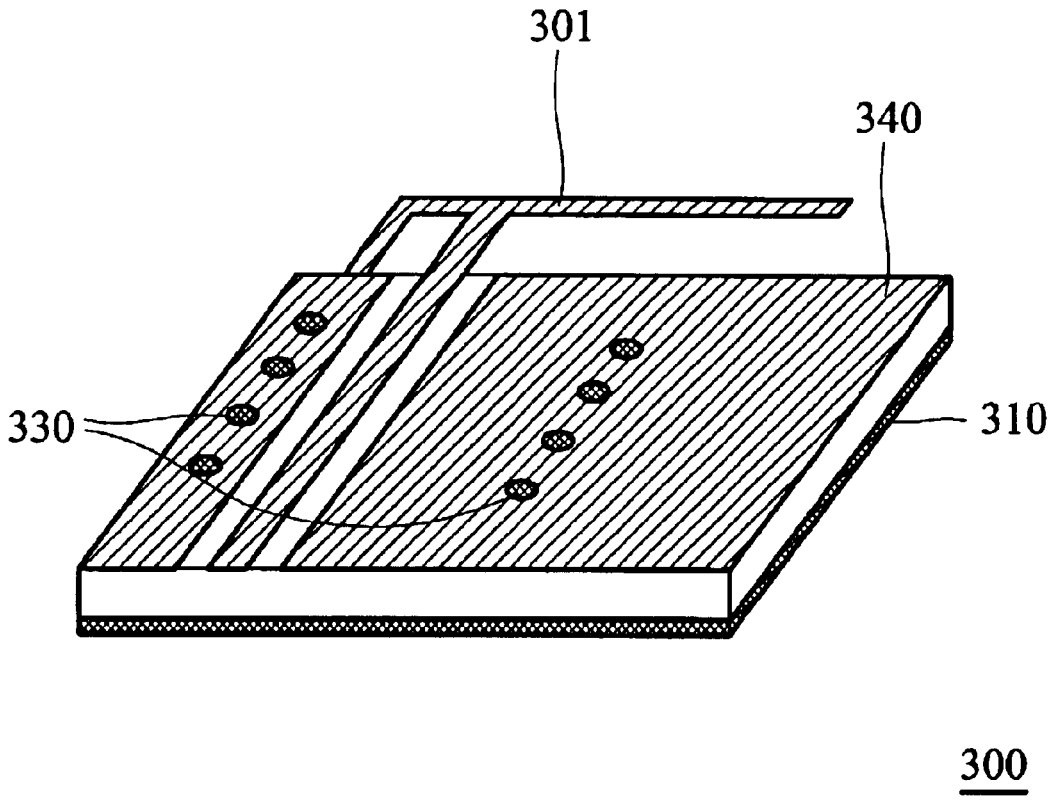
FIG. 3 ( PRIOR ART )
FIG. 3 (PRIOR ART) shows another planar inverted-F antenna with a directed feeding microstrip.
Figure 4A:
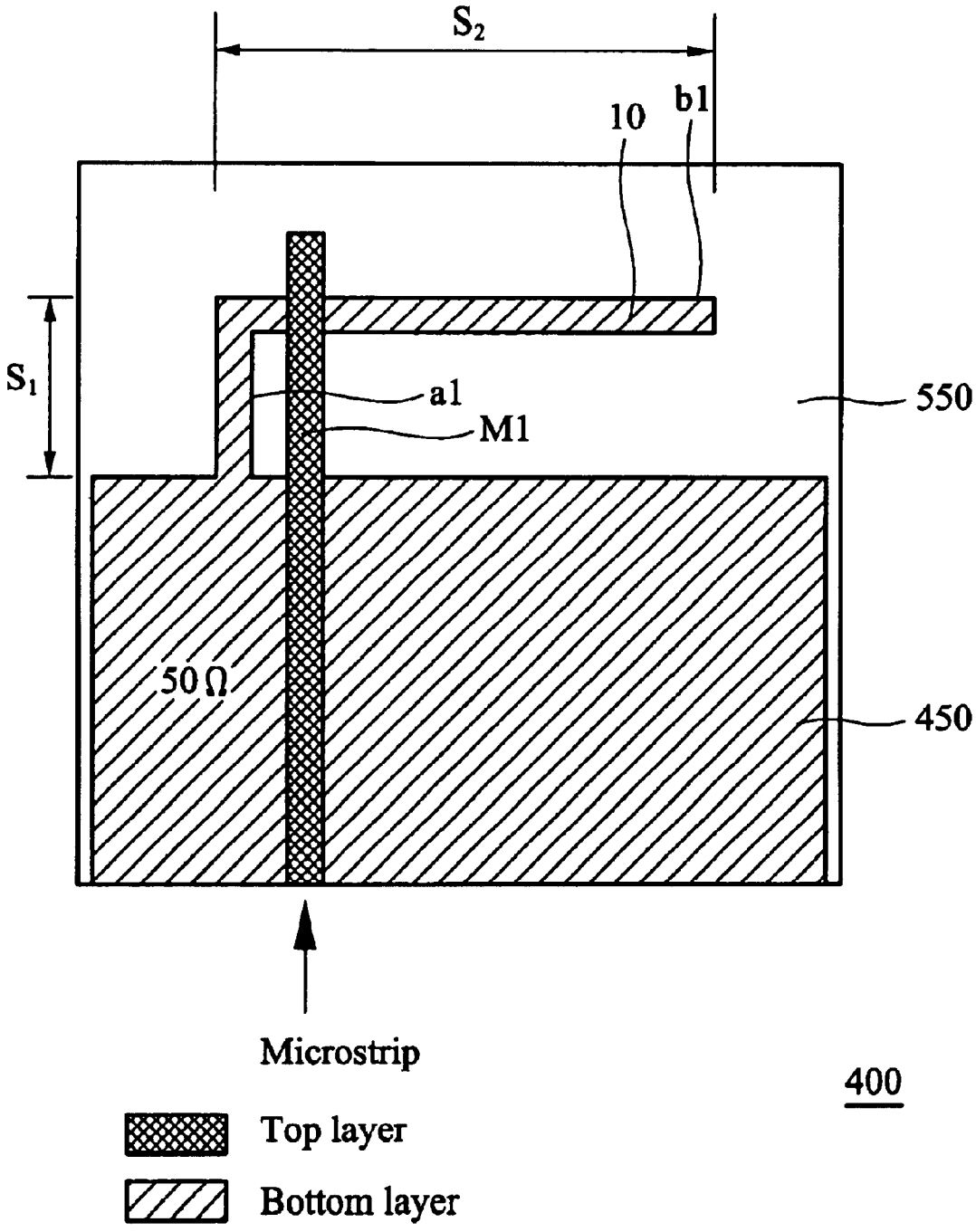
FIG. 4A shows the antenna structure according to the first embodiment of the present invention.

FIG. 4A shows the antenna structure according to the first embodiment of the present invention. Referring to FIG. 4A, the antenna 400 includes grounded radiator 10, and a feeding microstrip line M1. The feeding microstrip line M1 is disposed on one side of a substrate 550. The ground plane 450 and the grounded radiator 10 are disposed on the opposite side of the substrate 550.

The grounded radiator 10, a coupled metal strip connected electrically to a ground plane 450, includes a segment a1 and a segment b1. The segment a1 extends from an edge of the ground plane 450, and the segment b1 bends at a 90° angle connected to the segment a1.

A feeding microstrip line M1 is disposed above side of the ground plane 450 and parallel to the segment a1. The segment a1 is fed electromagnetically by the feeding microstrip line M1 rather than via holes or short pins. The antenna therefore avoids the fabrication process of via holes and short pins.

The length of the segment a1 is $S_1$. The length of the segment b1 is $S_2$. The radiation frequency of the antenna can be roughly estimated by the quarter-wavelength, which equals to a total length of the grounded radiator 10, $S_1+S_2$.

Figure 4B:
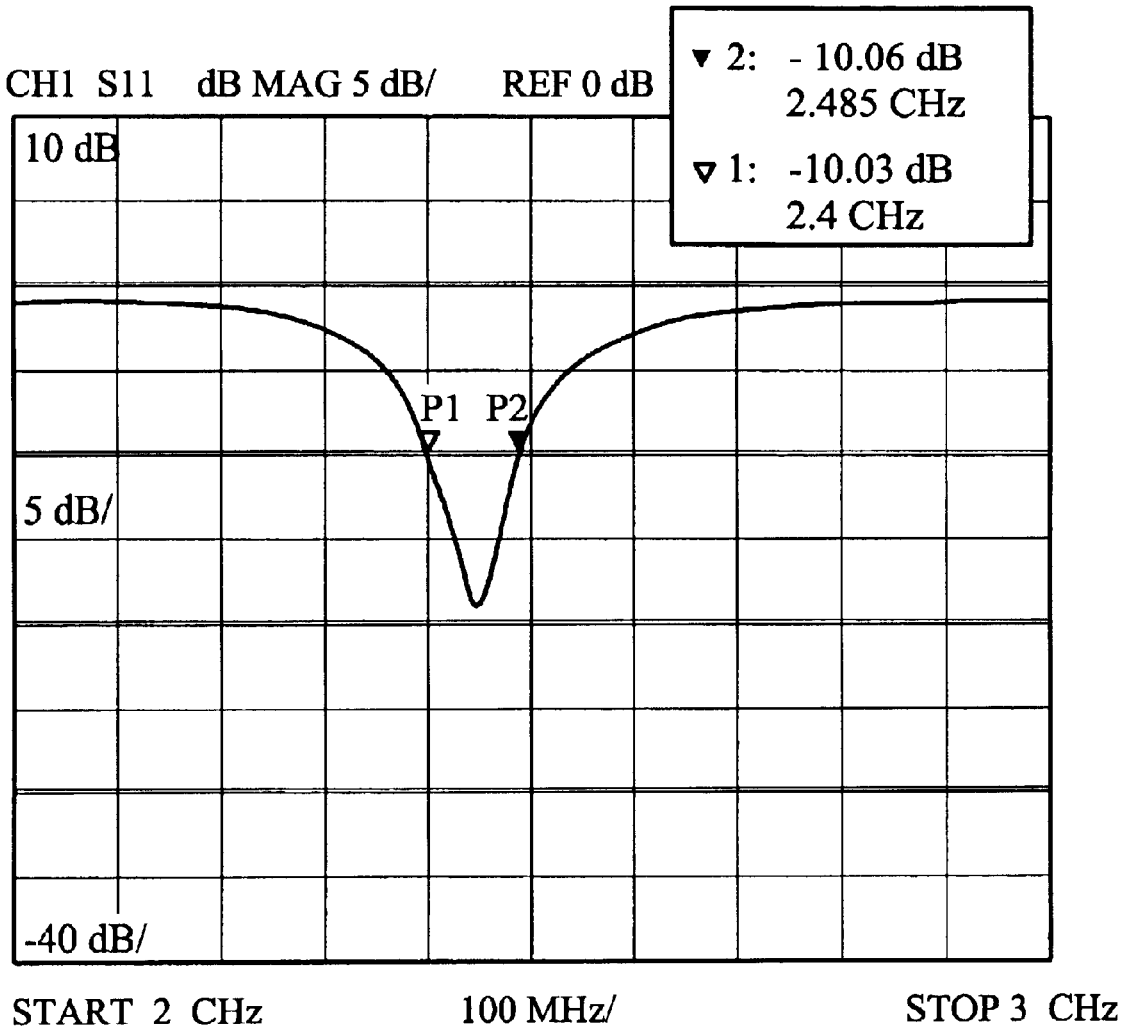
FIG. 4B shows the return loss of the antenna structure according to the first embodiment of the present invention.

The distance from a1 to the feeding microstrip line M1 can be adjusted to match the input impedance of the antenna. FIG. 4B shows the return loss (|S11|) of the antenna. The return loss of P1 is −10.03 dB at 2.4 GHz. The return loss of P2 is −10.06 dB at 2.485 GHz. Notably, the bandwidth (|S11|<−10 dB) of the antenna is about 85 MHz as shown in FIG. 4B. The frequency band of the applications of Bluetooth and WLAN is from 2400 MHz to 2483.5 MHz. Therefore, the antenna is adequate for these wireless applications.

Figure 5A:
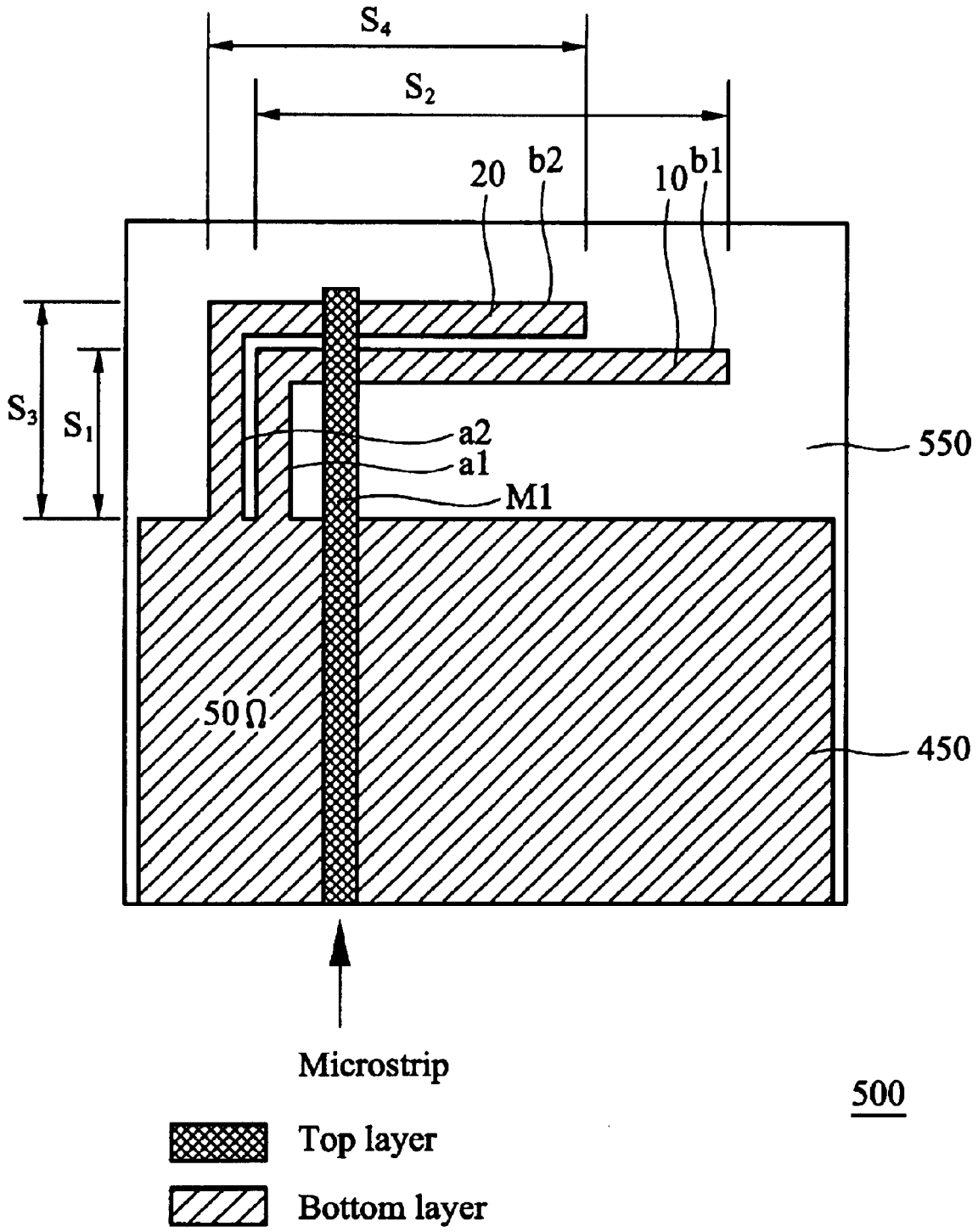
FIG. 5A shows the antenna structure according to the second embodiment of the present invention.

FIG. 5A shows the antenna structure according to the second embodiment of the present invention. Referring to FIG. 5A, the antenna 500 includes grounded radiator 10, 20, and a feeding microstrip line M1. The feeding microstrip line M1 is disposed on one side of a substrate 550. The ground plane 450 and the grounded radiator 10 and 20 are disposed on the opposite side of the substrate 550.

The grounded radiator 10, a coupled metal strip connected electrically to a ground plane 450, includes a segment a1 and a segment b1. The segment a1 extends from an edge of the ground plane 450, and the segment b1 bends at a 90° angle connected to the segment a1.

The grounded radiator 20, a coupled metal strip connected electrically to a ground plane 450, includes a segment a2 and a segment b2. The segment a2 is parallel to the segment a1 and extends from an edge of the ground plane 450. The segment b2 bends at a 90° angle connected to the segment a2.

A feeding microstrip line M1 is disposed above side of the ground plane 450 and parallel to the segment a1 and a2. The segment a1 and a2 is fed electromagnetically by the feeding microstrip line M1 rather than via holes or short pins. The antenna therefore avoids the fabrication process of via holes and short pins.

The length of the segment a1 is $S_1$. The length of the segment b1 is $S_2$. The length of the segment a2 is $S_3$. The length of the segment b2 is $S_4$.

Figure 5B:
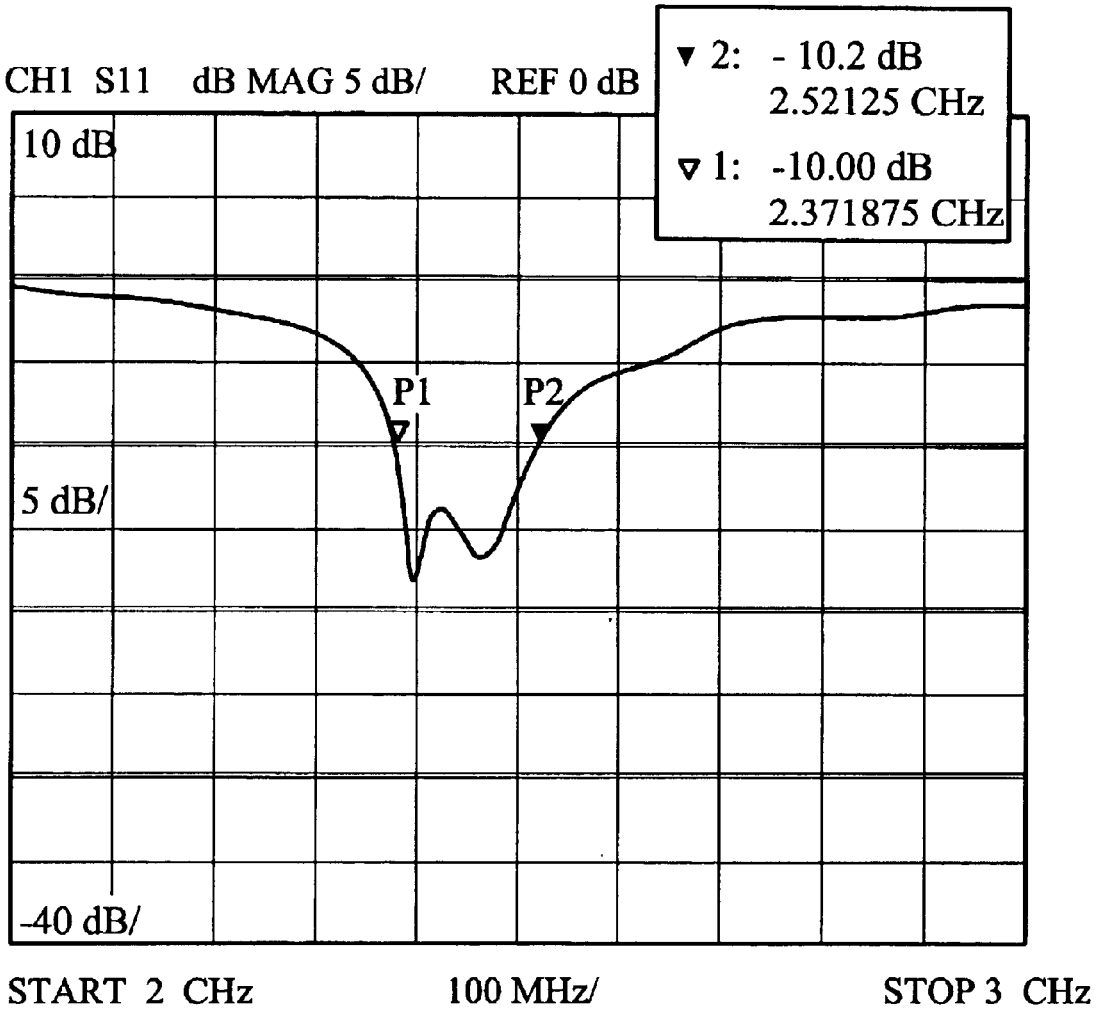
FIG. 5B shows the return loss of the antenna structure according to the second embodiment of the present invention.

The distance from a1 to the feeding microstrip line M1 can be adjusted to match the input impedance of the antenna. The significant merit of the grounded radiator 10 and 20 is to broaden the bandwidth of the antenna 500. FIG. 5B shows the return loss (|S11|) of the antenna. The return loss of P1 is −10.00 dB at 2.371 GHz. The return loss of P2 is −10.02 dB at 2.521 GHz. Notably, the bandwidth (|S11|<−10 dB) of the antenna is about 149 MHz as shown in FIG. 5B. The frequency band of the applications of Bluetooth and WLAN is from 2400 MHz to 2483.5 MHz. Therefore, the antenna is adequate for these wireless applications.

Figure 5C:
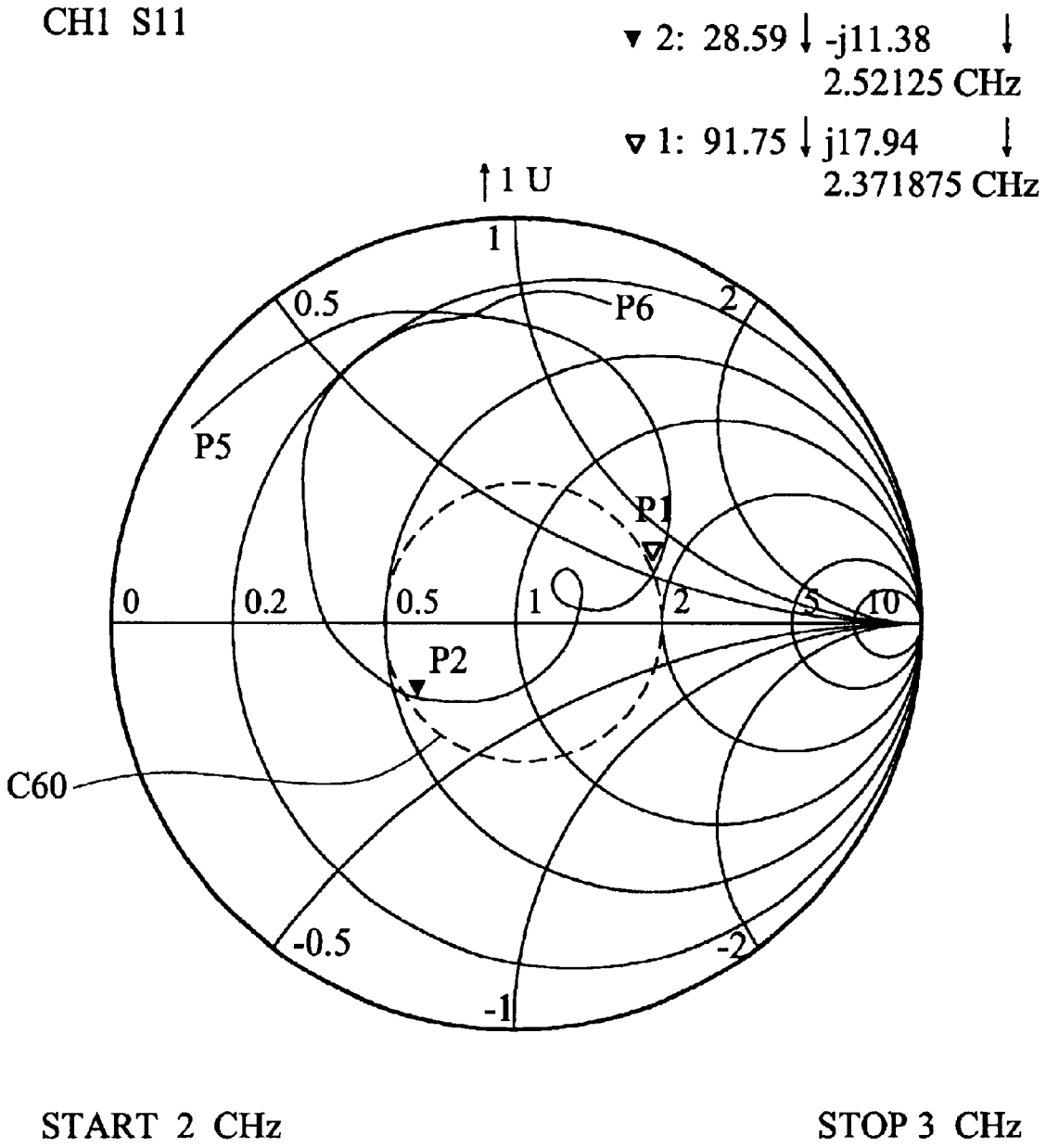
FIG. 5C shows the Smith chart illustrating the input impedance of the antenna structure according to the second embodiment of the present invention.

FIG. 5C is a Smith chart plot showing the variation of input impedance of the feeding microstrip line M1 from a start frequency of about 2 GHz to stop frequency 3 GHz. The circle C60 represents a constant voltage standing wave ratio (VSWR) circle. All impedance points in the Smith chart plot at the input of the feeding microstrip line M1, which corresponds to the curve starting from P1 to P2 in FIG. 5C, fall on or within the constant VSWR circle C60 having a VSWR of 2.0. A VSWR of 2.0 corresponds to an |S11| value of about −10 dB. Referring to FIG. 5C, the input impedance point P5 at the start frequency 2 GHz on the Smith chart creates a substantial impedance mismatch along the feeding microstrip line M1 and thus high VSWR and |S11| values. As the operating frequency is increased, the input impedance curve enters the constant VSWR circle C60 at a point P1 which corresponds to a frequency of about 2.371 GHz. The point P1 falls on the constant VSWR circle C60 and thus has a VSWR of 2.0 and an |S11| value of about −10.00 dB, as shown in FIG. 5C. The remaining frequencies up to 2.521 GHz are all within the constant VSWR circle C60 and therefore all result in a VSWR of less than 2.0 and |S11| values of better than −10 dB. The point P2 corresponds to the stop frequency 2.521 GHz of the plotted input impedance curve. The input impedance plot of FIG. 5C indicates that the feeding microstrip line M1 and grounded radiator 10, 20 can be well-matched over a relatively large bandwidth. As shown in FIG. 5C, the bandwidth of the antenna 500 is about 149 MHz.

Figure 6A:
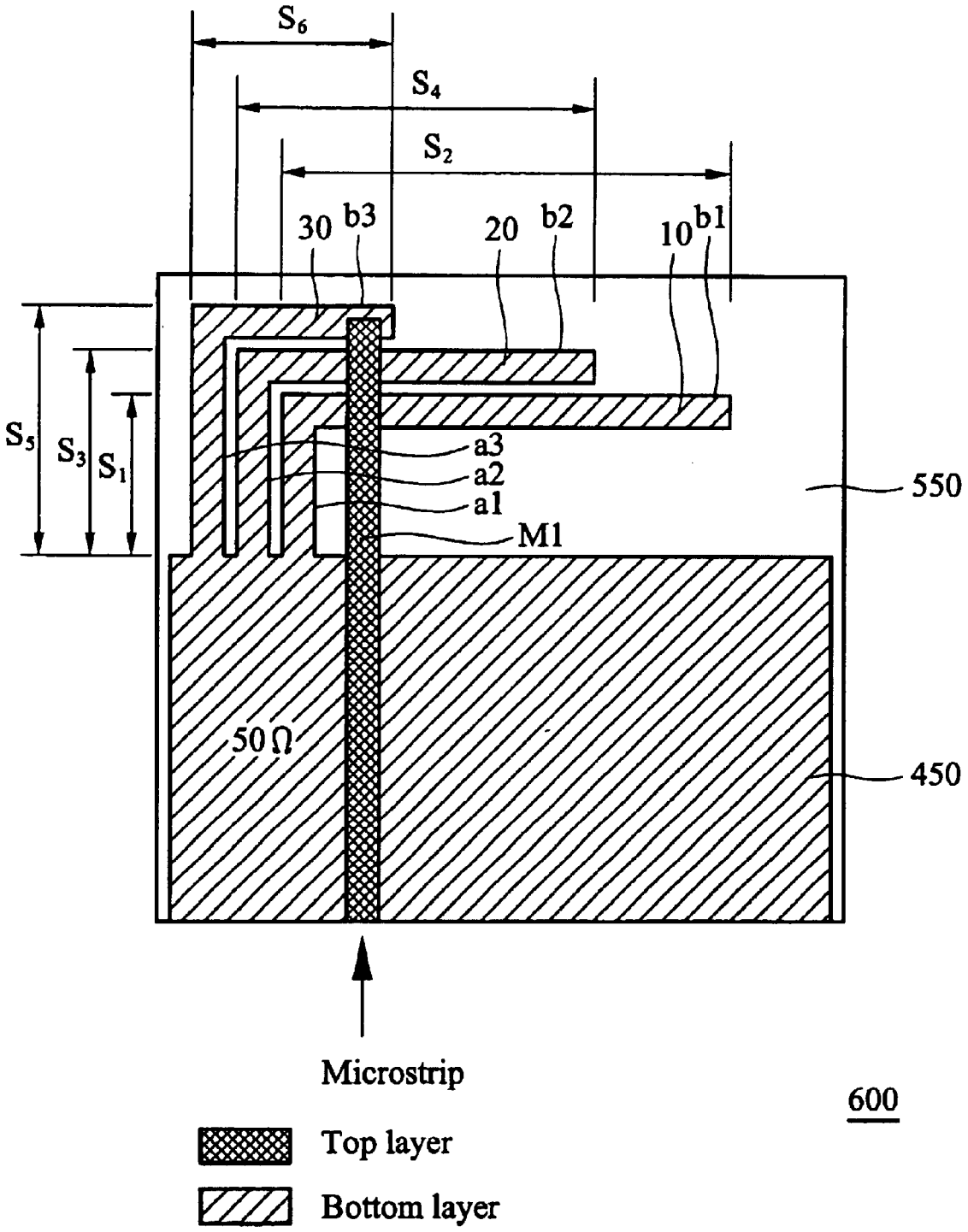
FIG. 6A shows the antenna structure according to the third embodiment of the present invention.

The second embodiment of the present invention discloses a microstrip-coupled antenna with greater bandwidth than the antenna disclosed in the first embodiment of the present invention. FIG. 6A shows the antenna structure according to the third embodiment of the present invention. Referring to FIG. 6A, the antenna 600 includes grounded radiator 10, 20, 30, and a feeding microstrip line M1. The feeding microstrip line M1 is disposed on one side of a substrate 550. The ground plane 450 and the grounded radiator 10, 20 and 30 are disposed on the opposite side of the substrate 550.

The grounded radiator 10, a coupled metal strip line connected electrically to a ground plane 450, includes a segment a1 and a segment b1. The segment a1 extends from an edge of the ground plane 450, and the segment b1 bends at a 90° angle connected to the segment a1.

The grounded radiator 20, a coupled metal strip line connected electrically to a ground plane 450, includes a segment a2 and a segment b2. The segment a2 is parallel to the segment a1 and extends from an edge of the ground plane 450. The segment b2 bends at a 90° angle connected to the segment a2.

Additionally, the grounded radiator 30, a coupled metal strip line connected electrically to a ground plane 450, includes a segment a3 and a segment b3. The segment a3 is parallel to the segment a1 and extends from an edge of the ground plane 450. The segment b3 bends at a 90° angle connected to the segment a3.

A feeding microstrip line M1 is disposed above side of the ground plane 450 and parallel to the segment a1, a2, and a3. The segment a1, a2, and a3 is fed electromagnetically by the feeding microstrip line M1 rather than via holes or short pins. The antenna therefore avoids the fabrication process of via holes and short pins.

The length of the segment a1 is $S_1$. The length of the segment b1 is $S_2$. The length of the segment a2 is $S_3$. The length of the segment b2 is $S_4$. The length of the segment a3 is $S_5$. The length of the segment b2 is $S_6$.

Figure 6B:
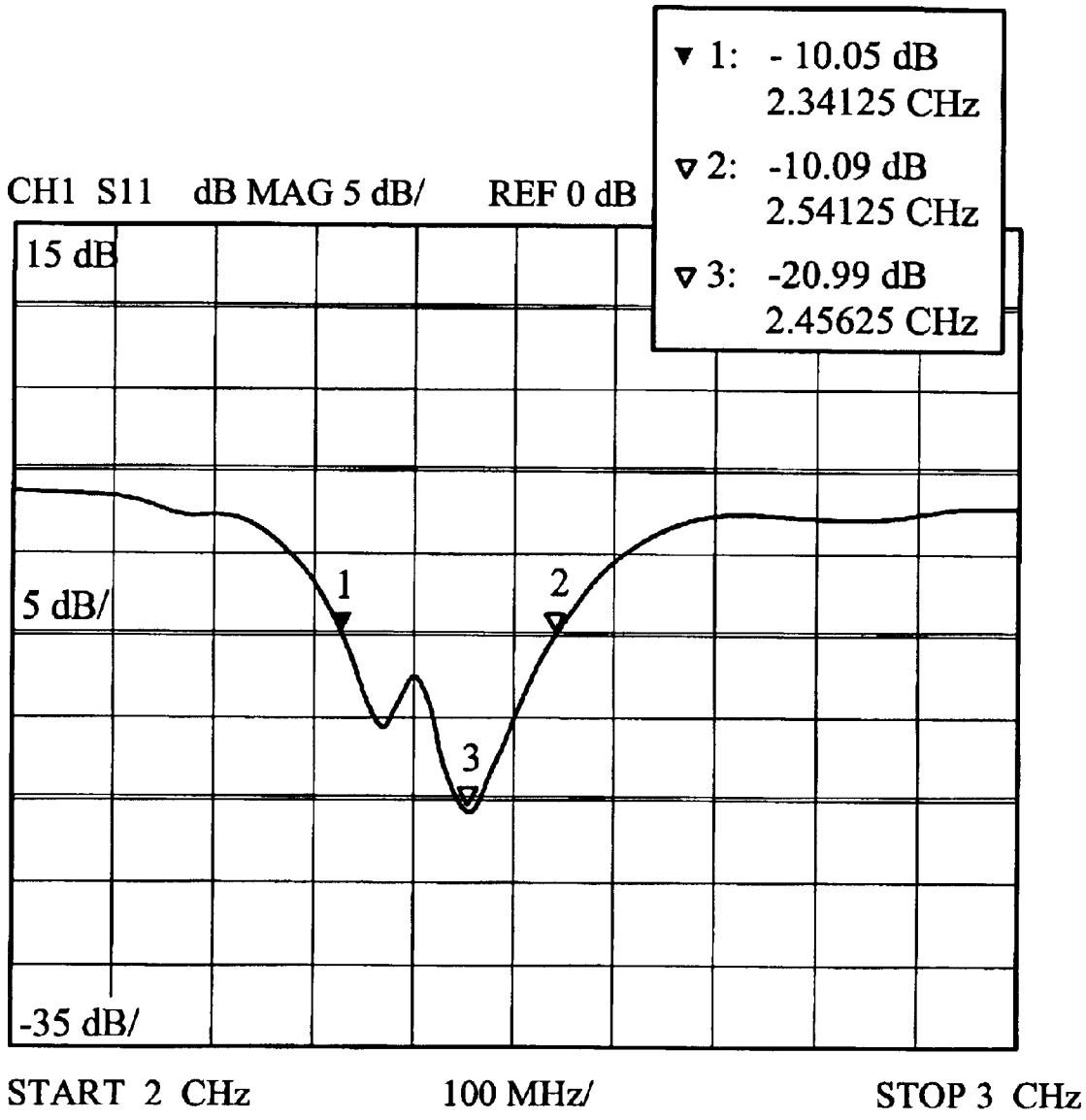
FIG. 6B shows the return loss of the antenna structure according to the third embodiment of the present invention.

The significant merit of the grounded radiator 10, 20, and 30 is to broaden the bandwidth of the antenna 600. FIG. 6B shows the return loss (|S11|) of the antenna. The return loss of P1 is −10.05 dB at 2.341 GHz. The return loss of P2 is −10.09 dB at 2.541 GHz. The return loss of P3 is −20.99 dB at 2.456 GHz. Notably, the bandwidth (|S11|<−10 dB) of the antenna is about 200 MHz as shown in FIG. 6B. The frequency band of the applications of Bluetooth and WLAN is from 2400 MHz to 2483.5 MHz. Therefore, the antenna is adequate for these wireless applications.

Figure 6C:
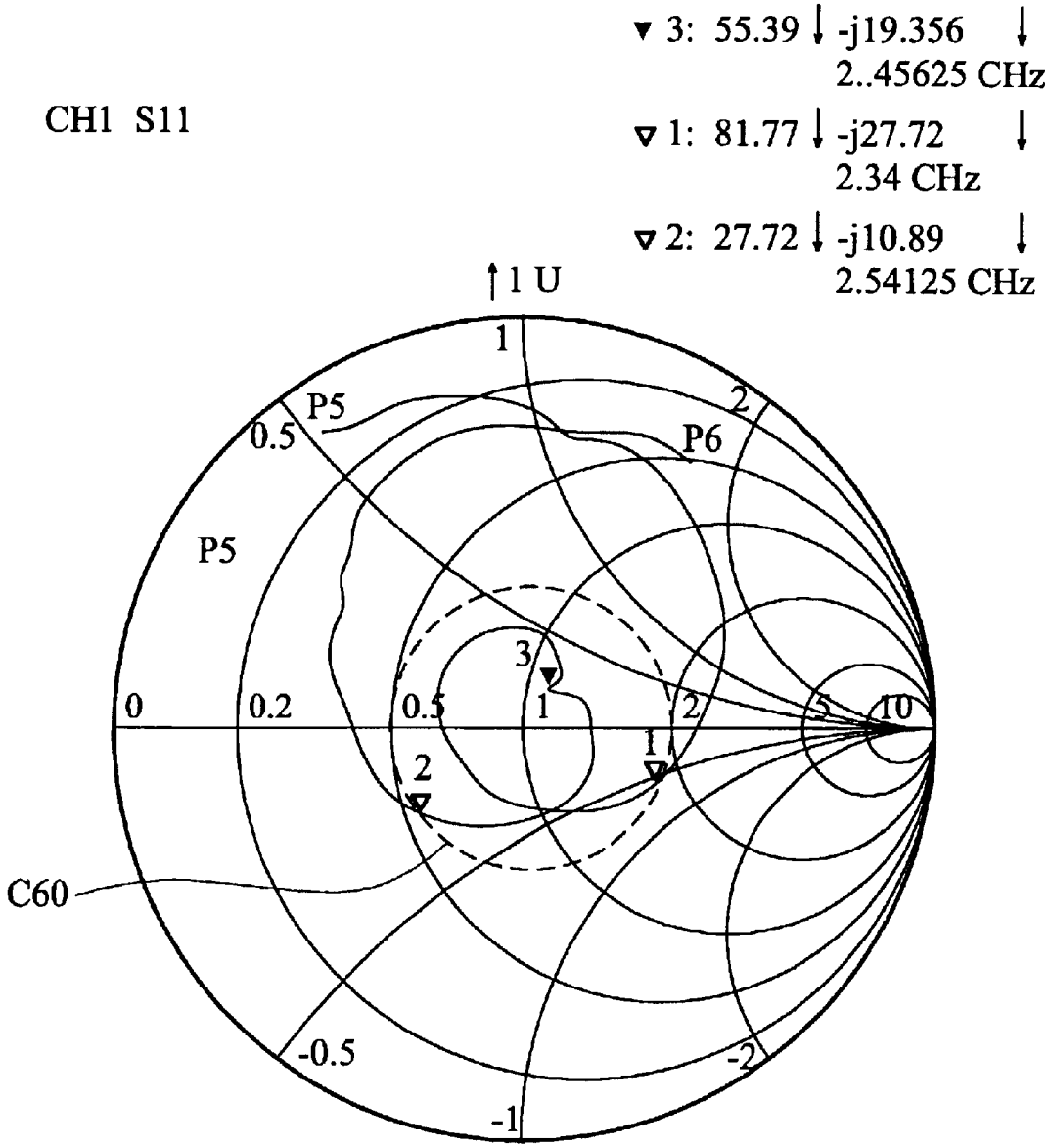
FIG. 6C shows the Smith chart illustrating the input impedance of the antenna structure according to the third embodiment of the present invention.

FIG. 6C is a Smith chart plot showing the variation of input impedance of the feeding microstrip line M1 from a start frequency of about 2 GHz to stop frequency 3 GHz. The circle C60 represents a constant voltage standing wave ratio (VSWR) circle. All impedance points in the Smith chart plot at the input of the feeding microstrip line M1, which corresponds to the curve starting from P1 to P2 in FIG. 6C, fall on or within the constant VSWR circle C60 having a VSWR of 2.0. A VSWR of 2.0 corresponds to an |S11| value of about −10 dB. Referring to FIG. 6C, the input impedance point P5 at the start frequency 2 GHz on the Smith chart creates a substantial impedance mismatch along the feeding microstrip line M1 and thus high VSWR and |S11| values. As the operating frequency is increased, the input impedance curve enters the constant VSWR circle C60 at a point P1 which corresponds to a frequency of about 2.341 GHz. The point P1 falls on the constant VSWR circle C60 and thus has a VSWR of 2.0 and an |S11| value of about −10.05 dB, as shown in FIG. 6C. The remaining frequencies up to 2.541 GHz are all within the constant VSWR circle C60 and therefore all result in a VSWR of less than 2.0 and |S11| values of better than −10 dB. The point P3 falls near a zero reactance line on the Smith chart and are corresponding to a frequency of about 2.456 GHz. The point P2 corresponds to the stop frequency 2.54 GHz of the plotted input impedance curve. The input impedance plot of FIG. 6C indicates that the feeding microstrip line M1 and grounded radiator 10, 20, and 30 can be well-match over a relatively large bandwidth.

The present invention utilizes a feeding microstrip line coupling signals to the grounded radiator without using via hole or stacked antenna or short pin. It avoids the excessive cost and additional fabrication processes. The antenna is highly compatible with the PCB structure. The feeding microstrip line is formed on the same metal layer of the signal microstrip line. The grounded radiators are formed on the same layer of the ground plane. The number of the radiating strips is flexible for the required bandwidth of the couple-fed plannar antenna.

Although the present invention has been described in its preferred embodiment, it is not intended to limit the invention to the precise embodiment disclosed herein. Those who are skilled in this technology can still make various alterations and modifications without departing from the scope and spirit of this invention. Therefore, the scope of the present invention shall be defined and protected by the following claims and their equivalents.

What is claimed is:

1. An antenna for a communication circuit having a ground plane and a signal line comprising:

a first grounded radiator having a first segment connected to the ground plane and extended from an edge of the ground plane and a second segment bending at an angle connected to the first segment;

a second grounded radiator having a first segment connected to the ground plane and extended from an edge of the ground plane and a second segment bending at an angle connected to the first segment; and a feeding line connected to the signal line and extended from the edge of the ground plane and separated from the first segments of the grounded radiators such that signals are coupled to the first grounded radiator and the second grounded radiator;

wherein the grounded radiators are disposed in a same layer as the ground plane, and the feeding line is disposed in a different layer.

2. The antenna as claimed in claim 1 wherein the first grounded radiator has a length of approximately a quarter wavelength corresponding to a radiation frequency of the antenna.

3. The antenna as claimed in claim 1 wherein the first segment of the first grounded radiator is configured to provide impedance matching on the feeding line.

4. The antenna as claimed in claim 1 wherein the second segments of the grounded radiators bend at an angle of approximately 90 degrees connecting to the respective first segments.

5. The antenna as claimed in claim 1, further comprising:

a third grounded radiator having a first segment connected to the ground plane and extended from an edge of the ground plane and a second segment bending at an angle connected to the first segment.

6. An antenna for a communication circuit having a ground plane and a signal line comprising:

a grounded radiator having a first segment connected to the ground plane and extended from an edge of the ground plane and a second segment bending at an angle connected to the first segment; and a feeding line connected to the signal line and extended from the edge the ground plane and separated from the first segment of the grounded radiator such that signals are coupled to the grounded radiator;

wherein the grounded radiator is disposed in a same layer as the ground plane, and the feeding line is disposed in a different layer.

7. An antenna for a communication circuit having a ground plane and a signal line comprising:

a first grounded radiator having a first segment connected to the ground plane and extended from an edge of the ground plane and a second segment bending at an angle connected to the first segment;

a second grounded radiator having a first segment connected to the ground plane and extended from an edge of the ground plane and a second segment bending at an angle connected to the first segment;

a third grounded radiator having a first segment connected to the ground plane and extended from an edge of the ground plane and a second segment bending at an angle connected to the first segment, and;

a feeding line connected to the signal line and extended from the edge of the ground plane and separated from the first segments of the grounded radiators such that signals are coupled to the first, second and third grounded radiators;

wherein the grounded radiators are disposed in a same layer as the ground plane, and the feeding line disposed in a different layer.

8. The antenna for a communication circuit as claimed in claim 7, wherein the minimum number range of the grounded radiator is at least 1.

9. The antenna for a communication circuit as claimed in claim 8, wherein the maximum number range of the grounded radiators is not limited in 5.

10. The antenna as claimed in claim 1, wherein the feeding line is substantially parallel to the first segments of the grounded radiators.

11. The antenna as claimed in claim 10, wherein the feeding line overlaps the second segments of the grounded radiators.

12. The antenna as claimed in claim 1, wherein the ground plane and the grounded radiators are disposed on one surface of a substrate and the feeding line is disposed on the opposite surface of the substrate.

13. The antenna as claimed in claim 6, wherein the second segment of the grounded radiator bends at an angle of approximately 90 degrees connecting to the first segment.

14. The antenna as claimed in claim 6, wherein the feeding line is substantially parallel to the first segment of the grounded radiator.

15. The antenna as claimed in claim 14, wherein the feeding line overlaps the second segment of the grounded radiator.

16. The antenna as claimed in claim 6, wherein the ground plane and the grounded radiator are disposed on one surface of a substrate and the feeding line is disposed on the opposite surface of the substrate.

17. The antenna as claimed in claim 7, wherein the second segments of the grounded radiators bend at an angle of approximately 90 degrees connecting to the respective first segments.

18. The antenna as claimed in claim 7, wherein the feeding line is substantially parallel to the first segments of the grounded radiators.

19. The antenna as claimed in claim 18, wherein the feeding line overlaps the second segments of the grounded radiators.

20. The antenna as claimed in claim 7, wherein the ground plane and the grounded radiators are disposed on one surface of a substrate and the feeding line is disposed on the opposite surface of the substrate.

* * * * *